United States Patent [19]

Iio

[11] Patent Number: 4,545,771

[45] Date of Patent: Oct. 8, 1985

[54] PROPELLER

[75] Inventor: Takeshi Iio, Hmamatsu, Japan

[73] Assignee: Sanshin Kogyo Kabushiki Kaisha, Japan

[21] Appl. No.: 513,848

[22] Filed: Jul. 14, 1983

[30] Foreign Application Priority Data

Aug. 23, 1982 [JP] Japan ..... 57-144798

[51] Int. Cl.[4] ..... B63H 1/20

[52] U.S. Cl. ..... 440/89; 440/88; 416/45; 416/93 A

[58] Field of Search ..... 440/88, 89; 416/45, 416/93 R, 90 A, 93 A; 415/DIG. 1

[56] References Cited

U.S. PATENT DOCUMENTS

| | | | |
|---|---|---|---|
| 1,824,739 | 9/1931 | Johnson | 416/93 M |
| 2,213,609 | 9/1940 | Ronning . | |
| 3,467,051 | 9/1969 | Shimanckas | 416/93 M |
| 3,542,487 | 11/1970 | Knuth | 416/93 M |
| 3,563,670 | 2/1971 | Knuth | 416/93 A |
| 3,754,837 | 8/1973 | Shimanckas | 416/93 A |
| 3,788,267 | 1/1974 | Strong . | |

*Primary Examiner*—Trygve M. Blix
*Assistant Examiner*—C. T. Bartz
*Attorney, Agent, or Firm*—Ernest A. Beutler

[57] ABSTRACT

A propeller and exhaust system for an outboard motor wherein performance is improved by permitting the flow of some exhaust gases in proximity to the propeller blades at low speeds so as to aerate this area and so as to preclude the aeration when the speed of the propeller exceeds a predetermined speed for improving thrust.

15 Claims, 5 Drawing Figures

PROPELLER

BACKGROUND OF THE INVENTION

This invention relates to a propeller for an outboard drive and more particularly to an improved exhaust system for the propulsion unit for an outboard drive.

In connection with outboard drives, such as the lower unit of an outboard motor, it has been the common practice to discharge a small amount of exhaust gases in proximity to the propeller blades to aerate the water around the blades. The reason for doing this is to decrease the viscosity of the water around the blades so as to reduce the drag resistance and permit rapid acceleration of the propeller. Although such arrangements provide for the desired result, they also have the tendency to reduce the viscosity of the water around the propeller when travelling at high speeds. Hence, there is a power loss that is attributed to this aeration when the boat is operating at high speeds.

It is, therefore, a principal object of this invention to provide an improved exhaust system for an outboard drive.

It is another object of the invention to provide an outboard drive exhaust system that aerates the propeller at low speeds to improve acceleration and which reduces the aeration at higher speeds so as to improve driving thrust.

It is a further object of this invention to provide an improved propeller, exhaust system for outboard drives.

It is another object of this invention to provide a propeller for an outboard drive that will introduce exhaust gases in proximity to the propeller blades at low speeds so as to aerate the blades and which will not provide this aeration when operating at higher speeds.

SUMMARY OF THE INVENTION

A first feature of this invention is adapted to be embodied in an exhaust system for a marine propulsion unit comprising a propeller driven by an engine and adapted to be submerged in the water for propelling a watercraft and an exhaust system for the engine that includes exhaust outlet means for delivering exhaust gases in proximity to the propeller for aerating the water around the propeller. In accordance with this feature of the invention, means are provided for controlling the discharge of exhaust gases from the exhaust outlet means for discharge of exhaust gases therefrom only at certain speeds of the propeller.

Another feature of this invention is adapted to be embodied in a propeller for an outboard drive comprising a hub portion that is adapted to be affixed to a propeller shaft for driving the watercraft and at least one blade extending outwardly from the hub portion. A main exhaust passage extends generally in an axial direction through the hub portion for discharging exhaust gases rearwardly. An auxiliary exhaust passage extends generally radially through the hub portion from the main exhaust passage to a point in proximity to the blade for aerating the water around the blade. In accordance with this feature of the invention, valve means control the discharge of exhaust gases through the auxiliary exhaust passage.

A still further feature of this invention is adapted to be embodied in an exhaust system for a marine propulsion unit comprising a propeller driven by an engine and adapted to be submerged in the water for propelling a watercraft and an exhaust system for the engine that includes an exhaust outlet means for delivering exhaust gases in proximity to the propeller for aerating the water around the propeller. In accordance with this feature of the invention, valve means are provided for controlling the discharge of exhaust gases from the exhaust outlet means.

DETAILED DESCRIPTION OF THE PREFERRED EMBODIMENTS

Figure 1:
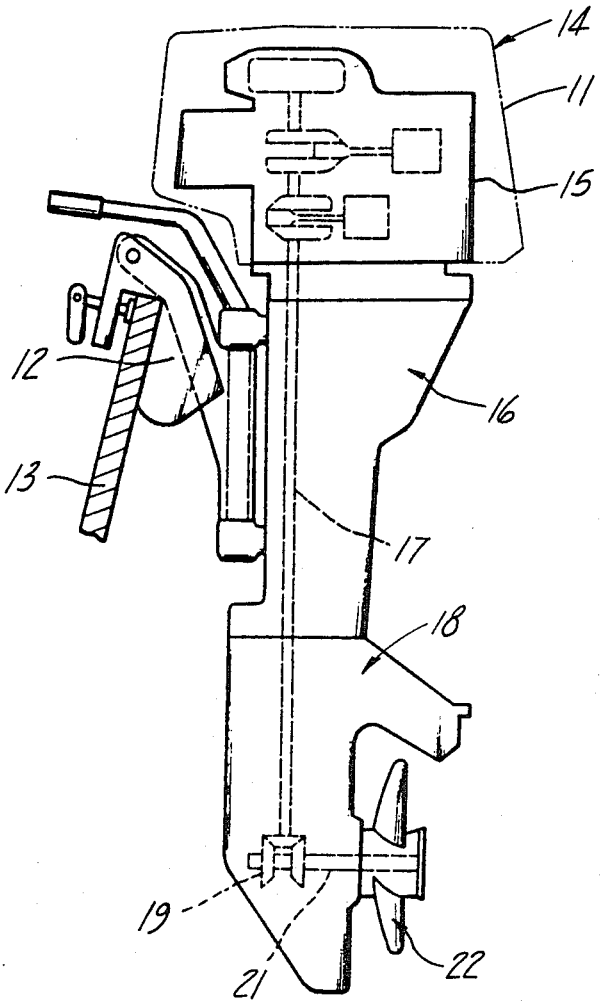
FIG. 1 is a side elevational view of an outboard motor constructed in accordance with this invention and showing the motor attached to the transom of an associated watercraft.

Referring first to the embodiment of FIGS. 1 through 4 and primarily to FIG. 1, an outboard motor constructed in accordance with this invention is identified generally by the reference numeral 11. The motor 11 is provided with a clamping bracket assembly 12 of a known type so as to permit attachment to a transom 13 of an associated watercraft, which is only shown partially.

The motor 11 includes a power head 14 in which an internal combustion engine 15 of any known type is provided. Depending from the power head 14 is a drive shaft housing 16 in which a drive shaft 17, which is driven by the engine 15, is journaled in a known manner. A lower unit 18 is positioned beneath the drive shaft housing 16 and contains a convental forward/neutral/reverse transmission 19 for driving a propeller shaft 21 which is jouranled in the lower unit 18. A propeller 22, constructed in accordance with this invention, is affixed in a manner to be described to the propeller shaft 21.

Figure 2:
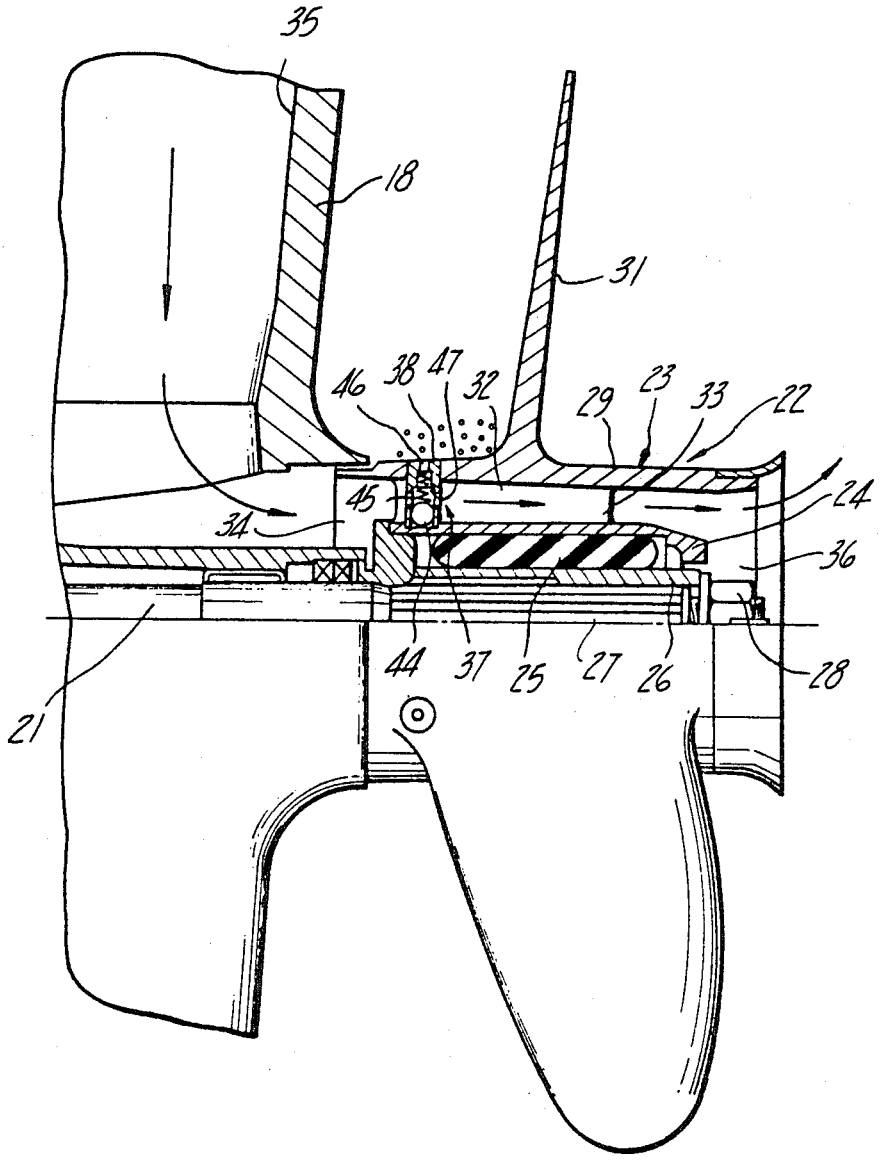
FIG. 2 is an enlarged side elevational view showing the propeller and exhaust gas discharge of the motor shown in FIG. 1, with portions shown in cross-section.
Figure 3:
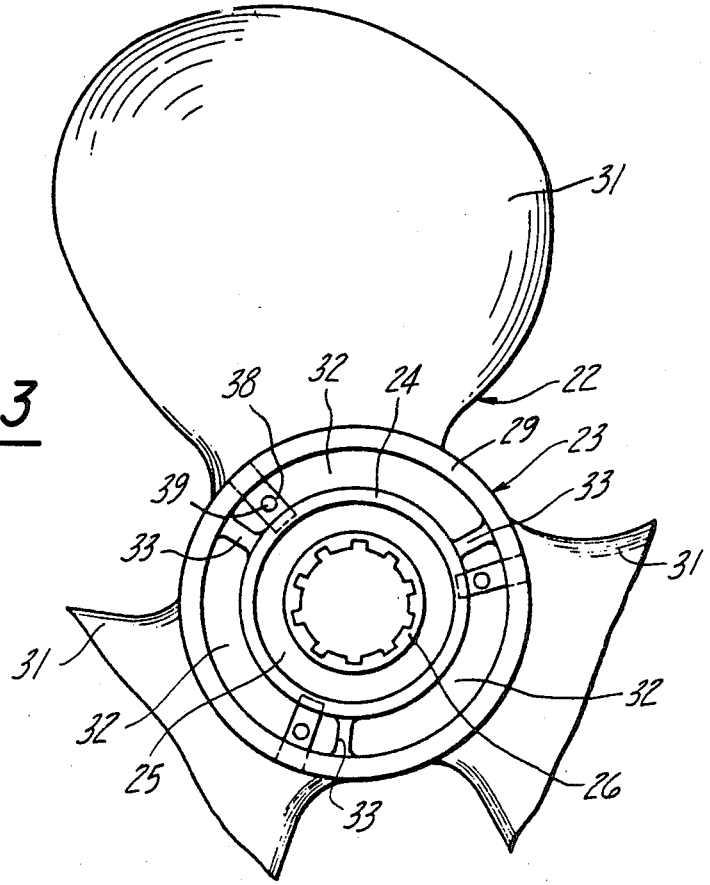
FIG. 3 is a front view of the propeller as shown in FIG. 2.
Figure 4:
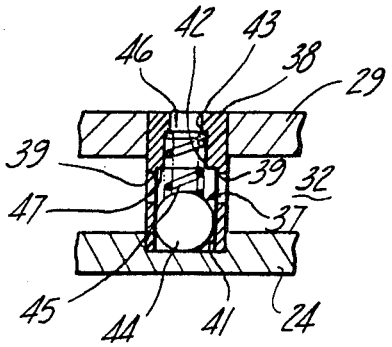
FIG. 4 is an enlarged cross-sectional view showing one of the valves associated with the propeller.

Referring now primarily to FIG. 2 through 3, the propeller 22 includes a hub assembly, indicated generally by the reference numeral 23. The hub assembly 23 includes an inner annular member 24 in which an elastomeric sleeve 25 is press fit. The inner end of the elastomeric sleeve 25 is received around a hub sleeve 26 and is affixed to it by means of a shrink fit. The hub sleeve 26 is formed with internal splines that cooperate with external splines 27 formed on the propeller shaft 21 for rotatably coupling the hub sleeve 26 to the propeller shaft 21. The propeller assembly 22 is affixed to the propeller shaft 21 by means including a nut 28.

The hub portion 23 is provided with an outer annular member 29 from which a plurality of propeller blades 31 integrally extend. In the illustrated embodiment, there are three propeller blades 31. It is to be understood, however, that the invention can be used in conjunction with propellers having different numbers of blades or different driving configurations.

A plurality of circumferentially spaced, axially extending main exhaust passages 32 are formed in the hub portion 29 between the outer portion 29 and the inner portion 24. The outer and inner portions 29, 24, are integrally connected by means of a plurality of radially extending ribs 33. The ribs 33 extend axially only partially through the hub portion 23 so as to provide a substantially open inlet end 34 at the forward end of the propeller 22 which open inlet end is adapted to register with an exhaust passage 35 that extends through the drive shaft housing 16 and lower unit 18 for delivering exhaust gases from the engine 15 through a muffling system (not shown) to the propeller inlet end 34.

The rear end of the propeller hub 23 is also open around the nut 28 so as to provide a main exhaust gas discharge 36. The exhaust gases flow axially through the propeller 22 from the inlet end 34 through the exhaust passages 32 for discharge into the water through the outlet end 36.

The propeller 22 and exhaust system are provided with a plurality of aerating devices 37 (FIG. 4) for introducing exhaust gases under certain conditions in proximity to the propeller blades 31. By introducing exhaust gases in proximity to the propeller blades 31, the water in this area is aerated so as to reduce its viscosity. This in turn reduces the resistance to rotation of the propeller 22 and facilitates acceleration of the propeller 22. In accordance with the invention, however, this aeration is discontinued by the devices 37 when the rotational speed of the propeller 22 exceeds a predetermined value. In this way, the aeration is not accomplished during steady state running or at high speed running so as to improve the thrust by reducing the aeration.

The devices 37 each comprise cylindrical housing members 38 that are press fit into bores that extend generally radially through the hub portion 23 from the outer cylindrical part 29 to and which terminate within the inner cylindrical portion 24. The bores in which the housings 38 are pressed extend generally radially and are positioned forwardly of the blades 31 and in an area between the ribs 33 and within the exhaust gas passages 32. The housings 38 are formed with bores 39 that extend transversely through the housing 38 so as to provide an exhaust gas path through this housing in registry with the exhaust gas passages 32. The bores 39 intersect a counterbored portion made up of a larger bore 41, an intermediate bore 42 and a smaller bore 43 that are disposed in that radial alignment extending outwardly from the inner member 24 to the outer member 29.

A velocity responsive valve comprising a ball 42 is provided in this counterbored portion. The ball 44 is supported in the larger diameter bore 41 and is urged by a coil spring 45 into a position in which it engages the base of the bore at the inner cylindrical portion 24 so as to permit free communication between the bores 39. The upper end of the spring 45 is received within the intermediate bore 42 and engages a seat between the bores 42 and 43. When the ball is held in this position, exhaust gases may enter the bore 39 and larger diameter bore 41 from the exhaust gas inlet 34. The exhaust gases may flow radially outwardly through the bore portions 42 and 43 through a resulting passageway, indicated at 46, for discharge forwardly of the propeller blades 31.

When the propeller 22 is rotating at sufficient velocity so as to overcome the action of the spring 45, the balls 44 will be urged radially outwardly by the centrifugal force and engages a seat 47 that is formed between the bore portions 41 and 42. When the seat 47 is engaged by the ball 44, the passage 46 will be closed and the discharge of exhaust gases in proximity with the propeller blades 31 will be discontinued.

When the motor 11 is operating at low speeds, the propeller 22 will rotate slowly and there will be insufficient centrifugal force generated on the balls 44 to overcome the action of the spring 45. Hence, a portion of the exhaust gases delivered from the exhaust passage 34 will be diverted through the bores 39 for discharge through the passages 46 in proximity to the propeller blades 31. This will achieve an aeration effect which will reduce the viscosity of the water surrounding the propeller blades 31 and reduce the resistance to rotation. Hence, if the engine is being started or accelerated, the acceleration will be rapid due to the low resistance.

As the speed of the propeller 22 increases to the value at which the balls 44 begin to move, the centrifugal force on the balls 44 will cause the springs 45 to be compressed and the balls 44 will engage the seats 47 to close the ports 46. Aeration in proximity to the propeller blades 31 will be discontinued and a good driving thrust can be enjoyed. Hence, the propeller 22 will operate with good efficiency at cruising or high speeds.

Figure 5:
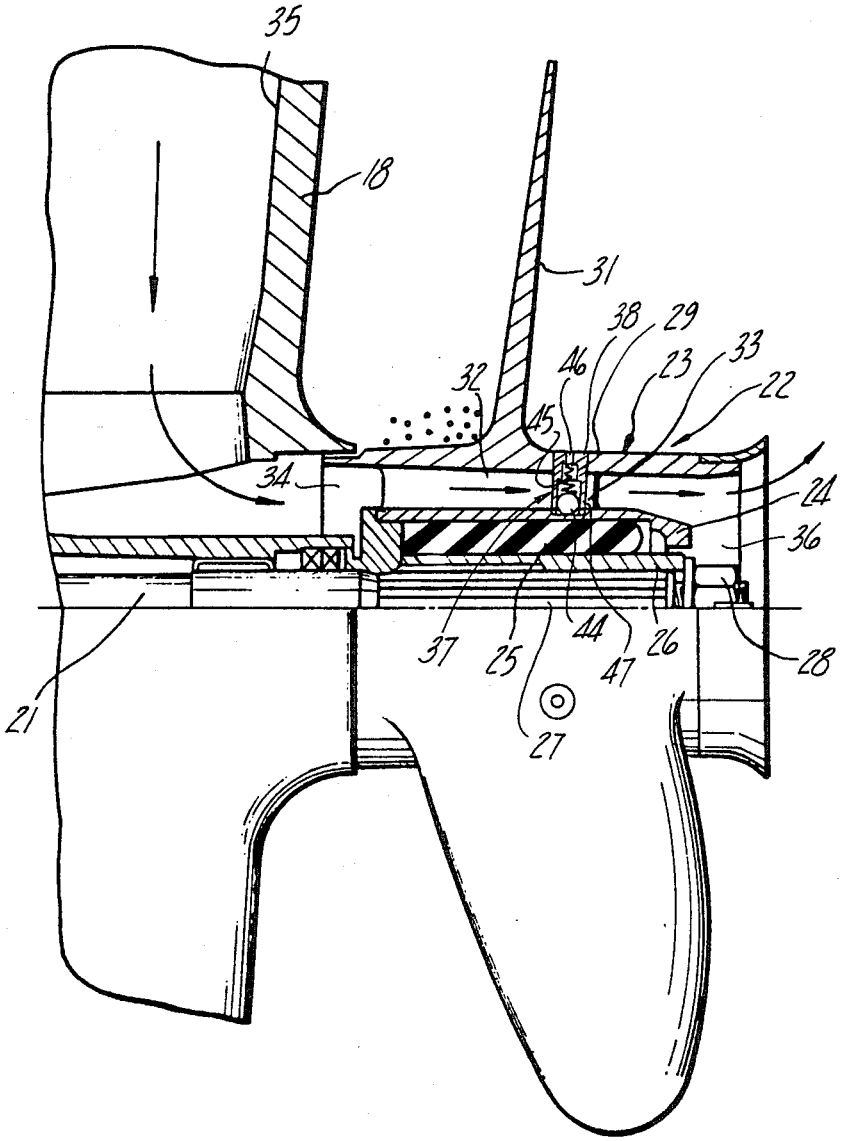
FIG. 5 is a view, in part similar to FIG. 2, showing another embodiment of the invention.

As has been noted, the ports 46 should be placed in proximity to the propeller blades 31 so as to provide the desired aeration at low speeds. In the embodiment of FIGS. 1 through 4, the devices 37 are positioned upstream of the propeller blades 31. They may be placed at other locations including a location immediately downstream, as shown in the embodiment of FIG. 5. In all other regards, this embodiment is the same as the embodiment of FIGS. 1 through 4 and further description is not believed to be necessary. For the same reason, the same components have been identified by the same reference numeral.

It is also to be understood that the number of devices 38 employed can be equal to the number of blades of the propeller or may be greater or lesser than the number of propeller blades. Furthermore, other types of control valves can be used than the ball type valve disclosed. It is desirable, however, to use a centrifugally operated valve because such valves are, as is well known, speed responsive.

Although certain embodiments of the invention have been disclosed and others described, various other changes and modifications may be made without departing from the spirit and scope of the invention, as defined by the appended claims.

I claim:

1. In an exhaust system for a marine propulsion unit comprising a propeller fixed against substantial axial movement to a shaft driven by an engine and adapted to be submerged in the water for propelling a watercraft and an exhaust system for the engine including exhaust outlet means for delivering exhaust gases in proximity to said propeller for aerating the water around said propeller, the improvement comprising speed responsive valve means for controlling the discharge of exhaust gases from said exhaust outlet means for discharge of exhaust gases therefrom only at certain speeds of said propeller.

2. In an exhaust system as set forth in claim 1 wherein the means for controlling the discharge of exhaust gases is effective to permit the discharge of exhaust gases only when the speed of the propeller is below a predetermined speed.

3. In an exhaust system as set forth in claim 1 wherein the speed responsive valve means includes an element actuated by centrifugal force.

4. In an exhaust system as set forth in claim 3 wherein the means for controlling the discharge of exhaust gases is effective to permit the discharge of exhaust gases only when the speed of the propeller is below a predetermined speed.

5. In an exhaust system as set forth in claim 4 wherein the speed responsive valve means comprises a radially extending member having a radially extending counterbore formed therein, the speed responsive member comprising a ball supported in the counterbore, and including passage means communicating the counterbore with the exhaust discharge of the engine and with the propeller in proximity to the blades.

6. In an exhaust system as set forth in claim 1 further including main exhaust gas discharge means extending through the propeller, the exhaust outlet means communicating at its inlet end with said main exhaust discharge means.

7. In an exhaust system as set forth in claim 6 wherein the main exhaust discharge means comprises a plurality of arcuately shaped, axially extending passages extending through the hub of the propeller.

8. In an exhaust system as set forth in claim 7 wherein the exhaust outlet means comprises radially extending passages extending from the main exhaust gas passages radially outwardly through the hub.

9. In an exhaust system as set forth in claim 8 wherein the speed responsive valve means for controlling the discharge of exhaust gases comprise valve means for controlling the flow through the radially extending hub passages.

10. In a propeller for an outboard drive comprising a hub portion adapted to be affixed to a propeller shaft for driving a watercraft, at least one blade extending outwardly from said hub portion, a continuously open main exhaust passage extending generally in an axial direction through said hub portion for discharging exhaust gases rearwardly, and a fixed size auxiliary exhaust passage extending generally radially through said hub portion from said main exhaust passage to a point in proximity to said blade for aerating the water around said blade, the improvement comprising valve means for controlling the discharge of exhaust gases through said auxiliary exhaust passage.

11. In a propeller as set forth in claim 10 wherein the valve means comprise speed responsive valve means.

12. In a propeller as set forth in claim 11 wherein the speed responsive valve means permits the flow of exhaust gases through the auxiliary exhaust passage only when the speed of the propeller is below a predetermined amount.

13. In a propeller as set forth in claim 12 wherein the speed responsive valve means includes a centrifugal element.

14. In a propeller as set forth in claim 13 wherein the speed responsive valve includes an element actuated by centrifugal force.

15. In a propeller as set forth in claim 14 wherein the speed responsive valve comprises a radially extending member having a radially extending counterbore formed therein, the speed responsive member comprising a ball supported in the counterbore, and including passage means communicating the counterbore with the exhaust discharge of the engine and with the propeller in proximity to the blades.

* * * * *